US007874233B1

(12) United States Patent
Taylor

(10) Patent No.: US 7,874,233 B1
(45) Date of Patent: Jan. 25, 2011

(54) ADAPTOR TOOL ASSEMBLY

(76) Inventor: Jeffrey L. Taylor, 11771 78th Ter., North, Seminole, FL (US) 33772

( * ) Notice: Subject to any disclaimer, the term of this patent is extended or adjusted under 35 U.S.C. 154(b) by 226 days.

(21) Appl. No.: 12/317,755

(22) Filed: Dec. 29, 2008

(51) Int. Cl.
*B25B 13/06* (2006.01)
*B25B 23/00* (2006.01)

(52) U.S. Cl. ..... 81/177.2; 81/121.1

(58) Field of Classification Search ..... 81/177.2, 81/437–439, 121.1, 180.1
See application file for complete search history.

(56) References Cited

U.S. PATENT DOCUMENTS 3,875,829 A * 4/1975 Evans et al. ..... 81/185
4,551,875 A 11/1985 Getz
D381,247 S * 7/1997 Zayat, Jr. ..... D8/29
5,943,924 A * 8/1999 Jarvis ..... 81/177.2
6,324,946 B1 * 12/2001 Gasser et al. ..... 81/121.1
6,418,821 B1 * 7/2002 Yamakawa ..... 81/437
6,945,139 B1 * 9/2005 Johnson ..... 81/57.3
6,948,408 B1 * 9/2005 Lee ..... 81/436
7,237,291 B2 7/2007 Redford
7,293,483 B1 * 11/2007 Hutchings et al. ..... 81/124.4
2001/0010833 A1 * 8/2001 Ray et al. ..... 427/180
2002/0178874 A1 * 12/2002 Lee ..... 81/177.2
2005/0098001 A1 * 5/2005 Walker ..... 81/439
2009/0095137 A1 * 4/2009 McKee ..... 81/121.1
2009/0107300 A1 * 4/2009 Cubberley ..... 81/119

* cited by examiner

*Primary Examiner*—David B Thomas

(57) ABSTRACT

A power input end and a power output end are provided. The tool has an interior bore along its entire length. The tool has an exterior surface with a hexagonal cross sectional configuration along its length from the power input end. The tool has a surface with a square cross sectional configuration from the power output end.

6 Claims, 6 Drawing Sheets

ADAPTOR TOOL ASSEMBLY

BACKGROUND OF THE INVENTION

1. Field of the Invention

The present invention relates to an adaptor tool assembly and more particularly pertains to applying a rotational force to inwardly facing rectangular surfaces through a fixed open end wrench, the applying of the force being in a safe, convenient and economical manner.

2. Description of the Prior Art

The use of tools of known designs and configurations is known in the prior art. More specifically, tools of known designs and configurations previously devised and utilized for the purpose of applying force through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 7,237,291 issued Jul. 3, 2007 to Redford relates to a Combined Nut Recess Cleaner and Nut Driver Tool and U.S. Pat. No. 4,551,875 issued Nov. 12, 1985 to Getz relates to a Combination Tool.

While these devices fulfill their respective, particular objectives and requirements, the aforementioned patents do not describe an adaptor tool assembly that allows for applying a rotational force to inwardly facing rectangular surfaces through a fixed open end wrench, the applying of the force being in a safe, convenient and economical manner.

In this respect, the adaptor tool assembly according to the present invention substantially departs from the conventional concepts and designs of the prior art, and in doing so provides an apparatus primarily developed for the purpose of applying a rotational force to inwardly facing rectangular surfaces through a fixed open end wrench, the applying of the force being in a safe, convenient and economical manner.

Therefore, it can be appreciated that there exists a continuing need for a new and improved adaptor tool assembly which can be used for applying a rotational force to inwardly facing rectangular surfaces through a fixed open end wrench, the applying of the force being in a safe, convenient and economical manner. In this regard, the present invention substantially fulfills this need.

SUMMARY OF THE INVENTION

In view of the foregoing disadvantages inherent in the known types of tools of known designs and configurations now present in the prior art, the present invention provides an improved adaptor tool assembly. As such, the general purpose of the present invention, which will be described subsequently in greater detail, is to provide a new and improved adaptor tool assembly and method which has all the advantages of the prior art and none of the disadvantages.

To attain this, the present invention essentially comprises an adaptor tool assembly. First provided is a workpiece. The workpiece has a generally cylindrical fixed member. The fixed member has internal female screw threads. The workpiece also has a generally cylindrical rotatable member. The rotatable member has external male screw threads. The male screw threads are received within the internal female screw threads of the fixed member. The rotatable member has four inwardly facing rectangular surfaces in a square configuration. The workpiece also has an elongated generally cylindrical stem. The stem extends outwardly from the fixed member and through the rotatable member. The stem and the rotatable member are laterally spaced. In this manner an annular space is formed.

A tool is provided. The tool has a power output end. The tool has a power input end. The tool has a cylindrical interior bore. The interior bore has a circular cross sectional configuration along its entire length. The tool has a first exterior surface. The first exterior surface has a hexagonal cross sectional configuration along the majority of its length from the power input end. The tool has a second exterior surface. The second exterior surface has a square cross sectional configuration. In this manner rectangular bearing surfaces are formed along the minority of its length from the power output end. The power output end is of a size to be positioned in the space between the stem and the rotational member. The four rectangular bearing surfaces of the power output end are in a force-applying contact with the four inwardly facing rectangular surfaces of the rotatable member, the stem being within the bore of the tool.

Provided last is a fixed open end wrench. The wrench has a handle. The handle is adapted to be held. The handle is further adapted to be rotated by a user. The wrench has an operational end. The wrench has contiguous rectangular surfaces. The contiguous rectangular surfaces are spaced about 120 degrees from each other. The contiguous rectangular surfaces are positionable in contact with the power input end of the tool. In this manner the tool is a rotatable member upon rotating the handle of the wrench.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adaptor tool assembly which has all of the advantages of the prior art tools of known designs and configurations and none of the disadvantages.

It is another object of the present invention to provide a new and improved adaptor tool assembly which may be easily and efficiently manufactured and marketed.

It is further object of the present invention to provide a new and improved adaptor tool assembly which is of durable and reliable constructions.

An even further object of the present invention is to provide a new and improved adaptor tool assembly which is susceptible of a low cost of manufacture with regard to both materials and labor, and which accordingly is then susceptible of low prices of sale to the consuming public, thereby making such adaptor tool assembly economically available to the buying public.

Even still another object of the present invention is to provide an adaptor tool assembly for applying a rotational force to inwardly facing rectangular surfaces through a fixed open end wrench, the applying of the force being in a safe, convenient and economical manner.

Lastly, it is an object of the present invention to provide a new and improved adaptor tool assembly. A power input end and a power output end are provided. The tool has an interior bore along its entire length. The tool has an exterior surface with a hexagonal cross sectional configuration along its length from the power input end. The tool has a surface with a square cross sectional configuration from the power output end.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
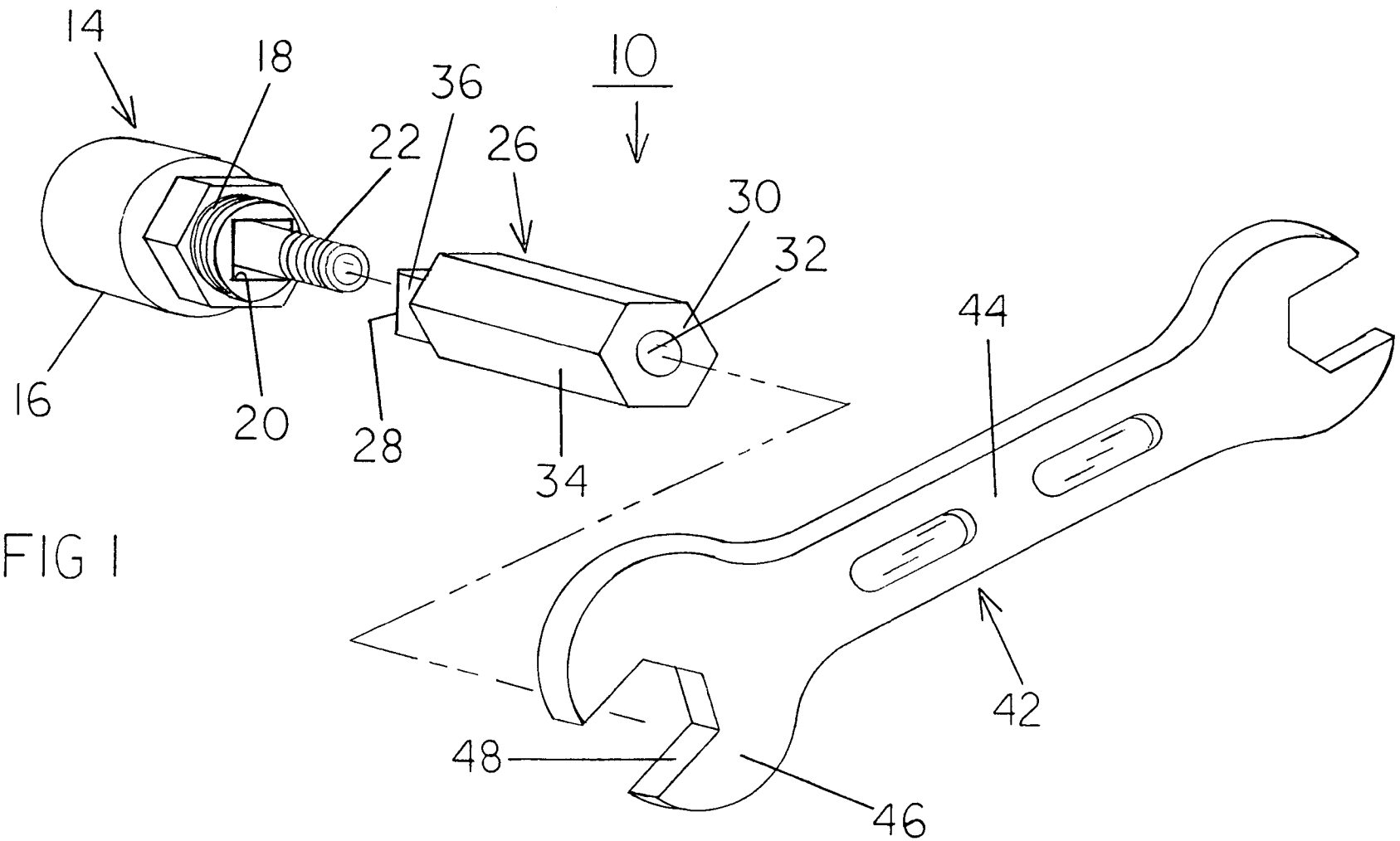
FIG. 1 is an exploded perspective illustration of an adaptor tool assembly constructed in accordance with the principles of the present invention.
Figure 2:
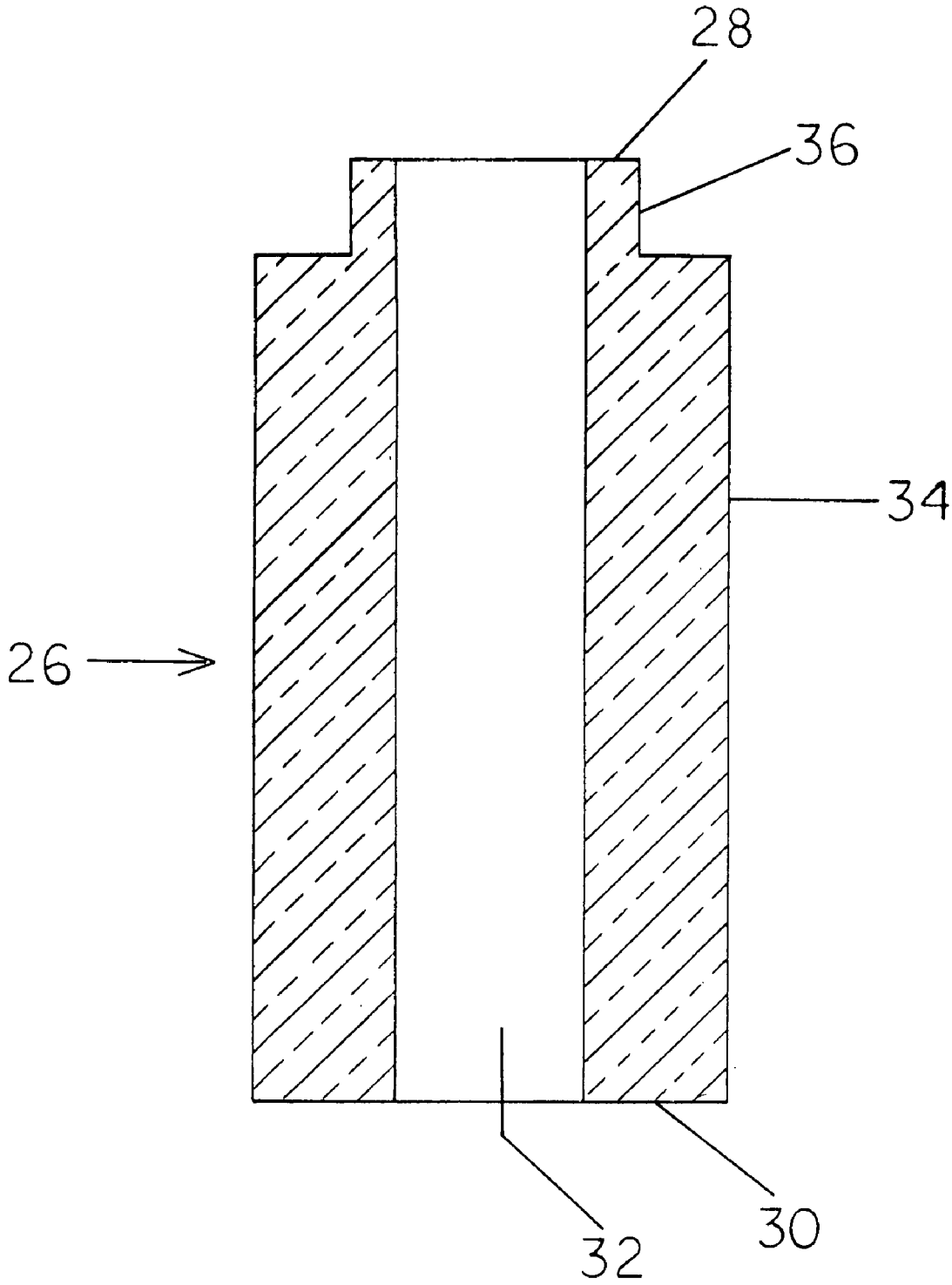
FIG. 2 is a cross sectional view taken axially through the adaptor tool of FIG. 1.
Figure 3A:
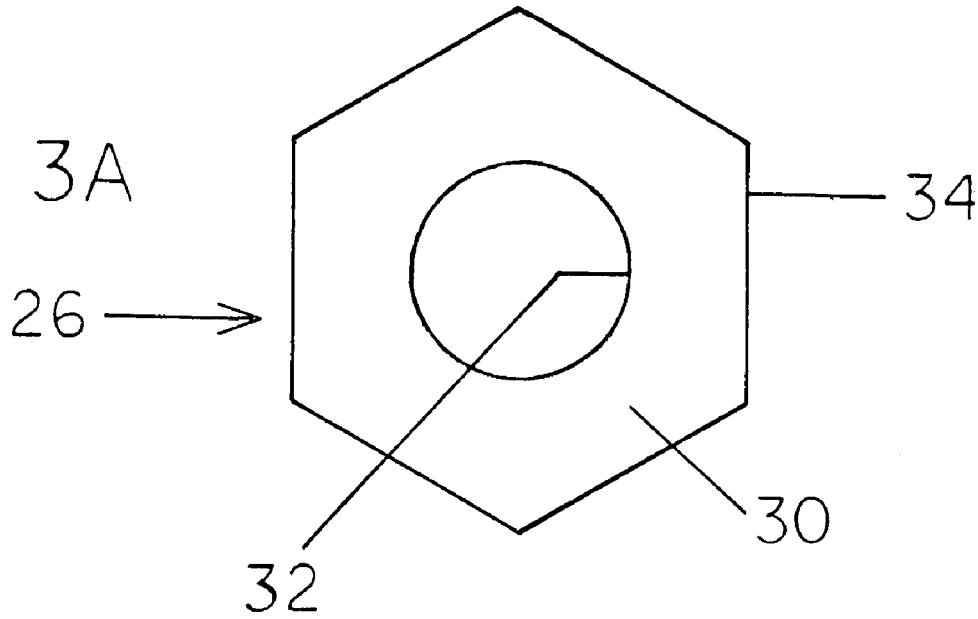
FIGS. 3A and 3B are end elevational views of the adaptor tool of the prior Figures.
Figure 3B:
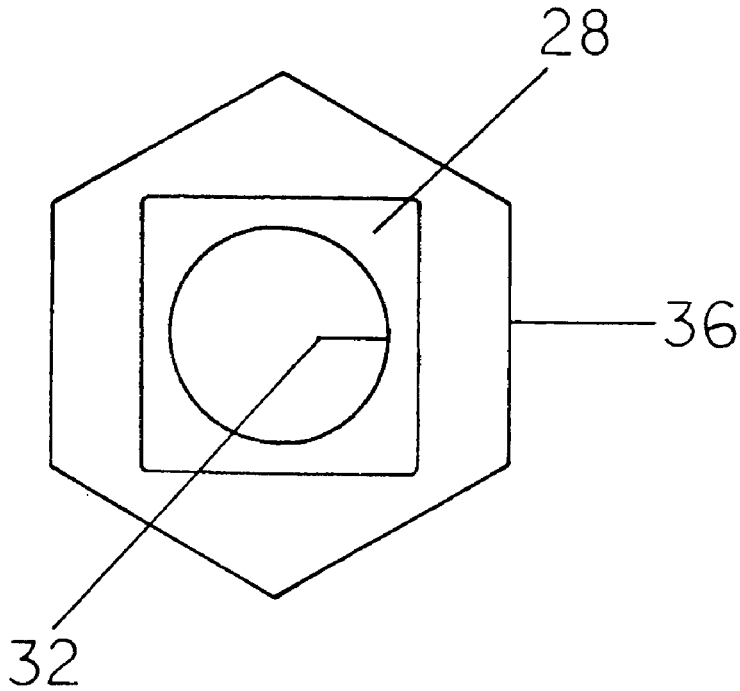
Figure 4:
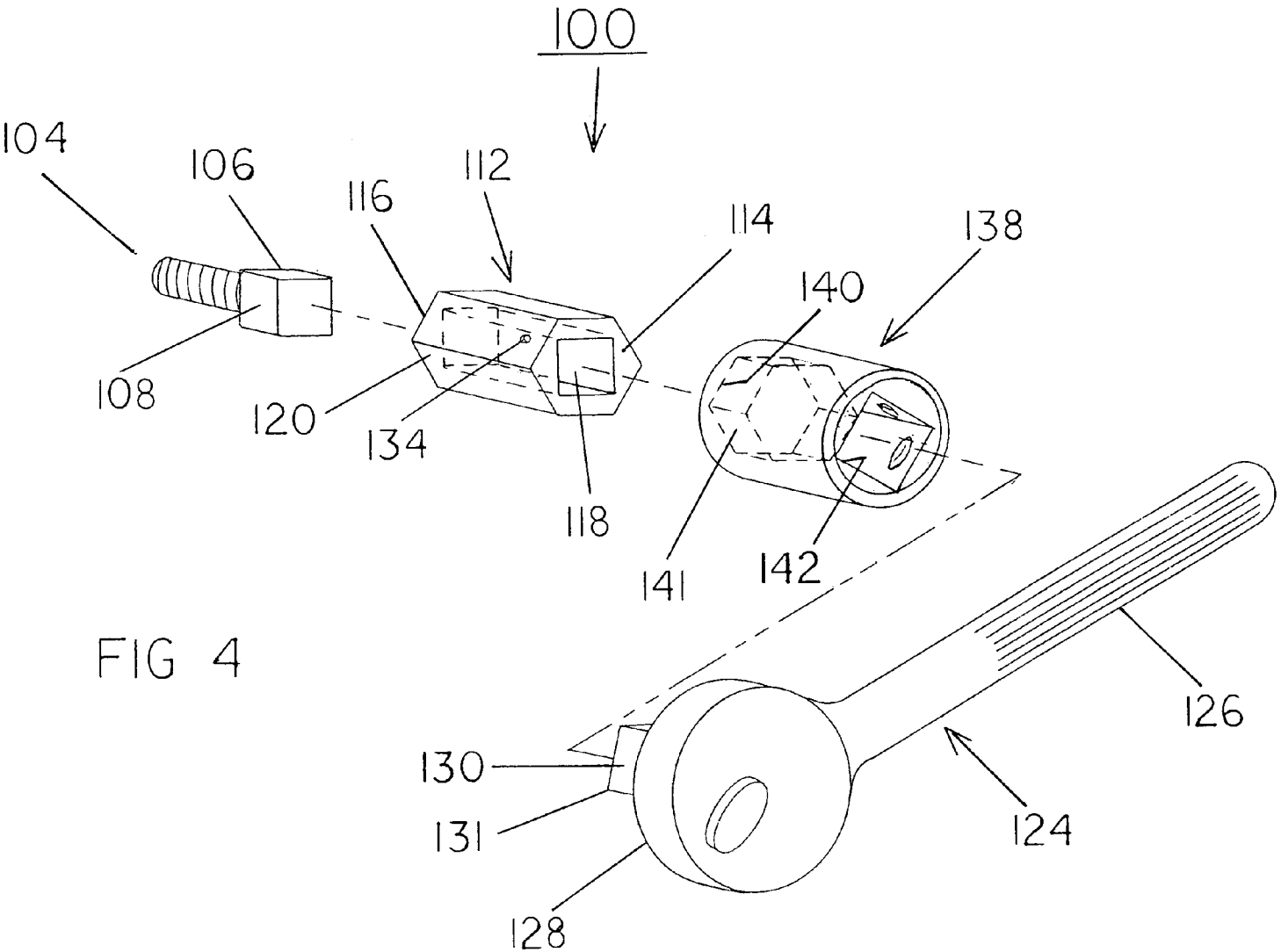
FIG. 4 is an exploded perspective illustration of an adaptor tool assembly constructed in accordance with an alternate embodiment of the invention.
Figure 5:
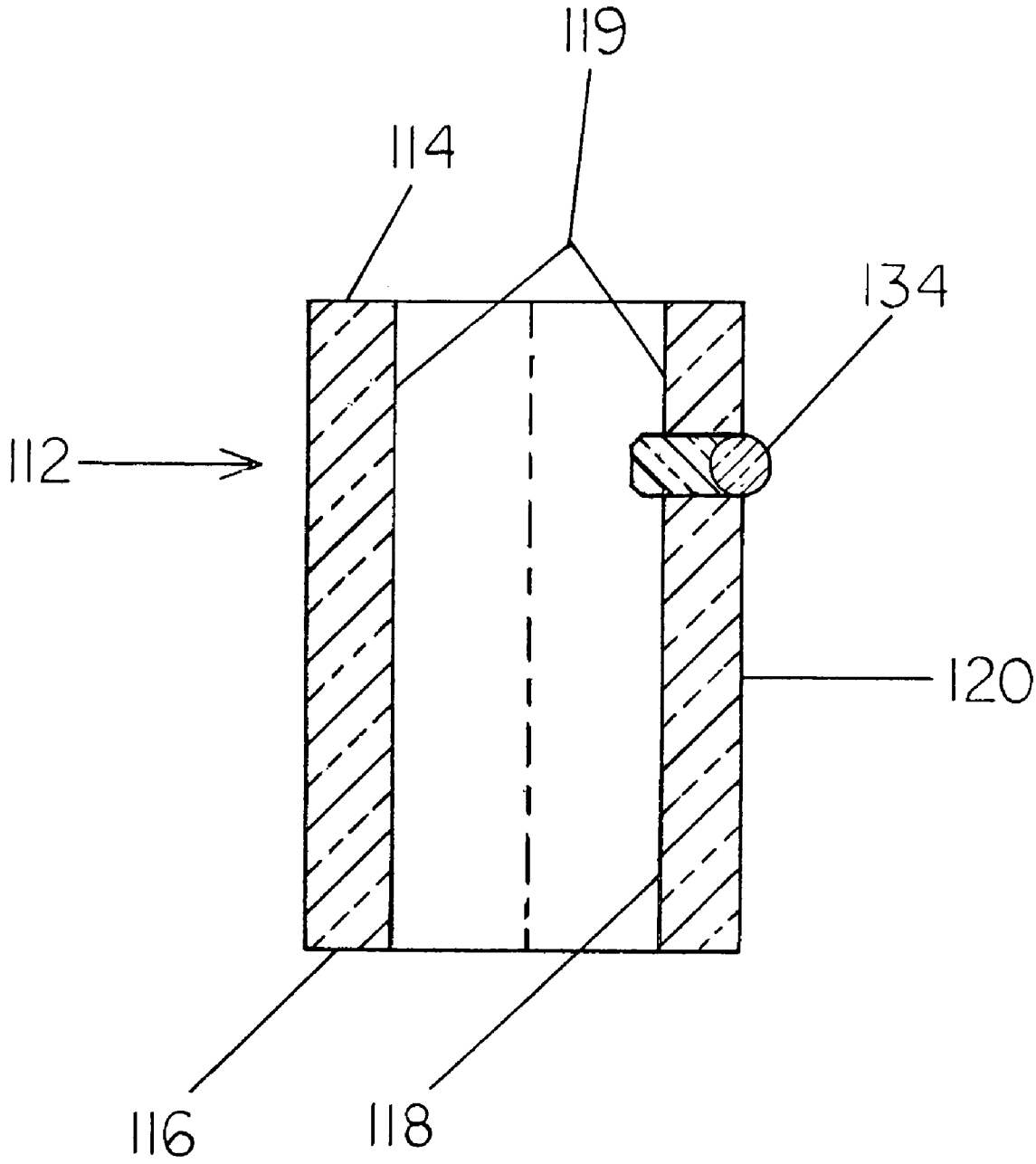
FIG. 5 is a cross sectional view taken axially through the adaptor tool of FIG. 4.
Figure 6:
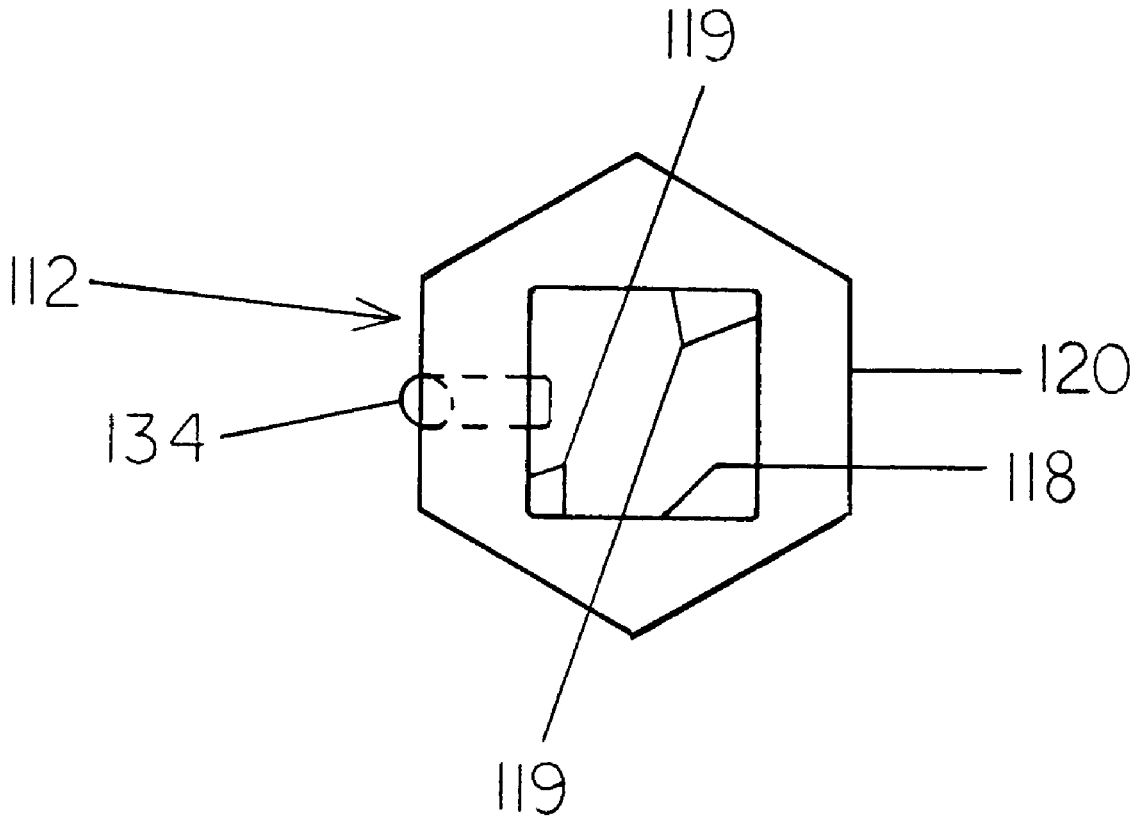
FIG. 6 is an end elevational view of the adaptor tool of FIGS. 4 and 5.

With reference now to the drawings, and in particular to FIG. 1 thereof, the preferred embodiment of the new and improved adaptor tool assembly embodying the principles and concepts of the present invention and generally designated by the reference numeral 10 will be described.

The present invention, the adaptor tool assembly 10 is comprised of a plurality of components. Such components in their broadest context include a power input end and a power output end. Such components are individually configured and correlated with respect to each other so as to attain the desired objective.

First provided is a workpiece 14. The workpiece has a generally cylindrical fixed member 16. The fixed member has internal female screw threads. The workpiece also has a generally cylindrical rotatable member 18. The rotatable member has external male screw threads. The screw threads are received within the internal female screw threads of the fixed member. The rotatable member has four inwardly facing rectangular surfaces 20 in a square configuration. The workpiece also has an elongated generally cylindrical stem 22. The stem extends outwardly from the fixed member and through the rotatable member. The stem and the rotatable member are laterally spaced. In this manner an annular space is formed.

A tool 26 is provided. The tool has a power output end 28. The tool has a power input end 30. The tool has a cylindrical interior bore 32. The interior bore has a circular cross sectional configuration along its entire length. The tool has a first exterior surface 34. The first exterior surface has a hexagonal cross sectional configuration along the majority of its length from the power input end. The tool has a second exterior surface 36. The second exterior surface has a square cross sectional configuration. In this manner rectangular bearing surfaces are formed along the minority of its length from the power output end. The power output end is of a size to be positioned in the space between the stem and the rotational member. The four rectangular bearing surfaces of the power output end are in a force-applying contact with the four inwardly facing rectangular surfaces of the rotatable member, the stem being within the bore of the tool.

Provided last is a fixed open end wrench 42. The wrench has a handle 44. The handle is adapted to be held. The handle is further adapted to be rotated by a user. The wrench has an operational end 46. The wrench has contiguous rectangular surfaces 48. The contiguous rectangular surfaces are spaced about 120 degrees from each other. The contiguous rectangular surfaces are positionable in contact with the power input end of the tool. In this manner the tool is a rotatable member upon rotating the handle of the wrench.

An alternate embodiment of the adaptor tool assembly 100 is provided. A workpiece 104 is provided. The workpiece is in the form of a rotatable bolt. The bolt has male screw threads. The bolt has a generally cubical head 106. The head has four outwardly facing rectangular surfaces 108 in a square configuration.

A tool 112 is provided. The tool has a power input end 114. The tool has a power output end 116. The tool has a rectangular interior bore 118. The bore has a square cross sectional configuration along its entire length. The bore has inwardly facing rectangular bearing surfaces 119. The tool has an exterior surface 120. The exterior surface has a hexagonal cross sectional configuration along its entire length. The power output end is of a size to be positioned over the head of the rotatable bolt. The four inwardly facing rectangular bearing surfaces of the power output end are in a force-applying contact with the four outwardly facing rectangular surfaces of the rotatable bolt.

Provided next is a socket wrench 124. The socket wrench has a handle 126. The handle is adapted to be held and rotated by a user. The socket wrench has an operational end 128. The operational end has a generally cubical drive. The drive has contiguous rectangular surfaces 130. The contiguous rectangular surfaces are spaced ninety degrees from each other.

A socket 138 is provided. The socket has a first end 140. The socket has interior rectangular surfaces 141. The interior rectangular surfaces are positionable over the exterior surface of the tool. The socket has a second end 142. The second end is adapted to receive the contiguous rectangular surfaces 130 of the drive. The contiguous rectangular surfaces are positionable in contact with the power input end of the tool. In this manner, a user rotating the handle of the wrench will concurrently rotate the socket and the tool for tightening and loosening the bolt with respect to a recipient surface.

Lastly provided is a spring urged ball 134. The spring urged ball extends exteriorly from the exterior surface of the tool. In this manner one of the interior rectangular surfaces of the socket is contacted. Further in this manner the contact between the socket and the tool is enhanced.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adaptor tool comprising, in combination:

a power input end and a power output end, the tool having an interior bore along its entire length, the tool having an exterior surface with a hexagonal cross sectional configuration along its length from the power input end, the tool having a surface with a square cross sectional configuration from the power output end wherein the tool has a cylindrical interior bore with a circular cross sectional configuration along its entire length, the tool having a first exterior surface with a hexagonal cross sectional configuration along the majority of its length from the power input end, the tool having a second exterior surface with a square cross sectional configuration forming rectangular bearing surfaces along the minority of its length from the power output end, the power output end being of a size to be positioned in a space between a stem and a rotational member with the four rectangular bearing surfaces of the power output end in a force-applying contact with four inwardly facing rectangular surfaces of the rotatable member, the stem being within the bore of the tool.

2. The tool as set forth in claim 1 and further including a wrench for coupling to the power input end.

3. An adaptor tool comprising, in combination:

a power input end and a power output end, the tool having an interior bore along its entire length, the tool having an exterior surface with a hexagonal cross sectional configuration along its length from the power input end, the tool having a surface with a square cross sectional configuration from the power output end wherein the interior bore has a square cross sectional configuration along its entire length forming four inwardly facing rectangular bearing surfaces, the tool having an exterior surface with a hexagonal cross sectional configuration along its entire length, the power output end being of a size to be positioned over a head of a rotatable bolt with the four inwardly facing rectangular bearing surfaces of the power output end in a force-applying contact with four outwardly facing rectangular surfaces of the rotatable bolt.

4. The tool as set forth in claim 3 and further including a socket wrench with a handle adapted to be held and rotated by a user and an operational end with a generally cubical drive having contiguous rectangular surfaces ninety degrees from each other; and a socket having a first end with interior rectangular surfaces positionable over the exterior surface of the tool and a second end adapted to receive the rectangular surfaces of the drive, the contiguous rectangular surfaces positionable in contact with the power input end of the tool for rotating the tool and rotatable member upon rotating the handle of the wrench.

5. An adaptor tool assembly for applying a rotational force to inwardly facing rectangular surfaces through a fixed open end wrench, the applying of the force being in a safe, convenient and economical manner, the adaptor tool assembly comprising, in combination:

a workpiece having a generally cylindrical fixed member with internal female screw threads, the workpiece also having a generally cylindrical rotatable member with external male screw threads received within the internal female screw threads of the fixed member, the rotatable member having four inwardly facing rectangular surfaces in a square configuration, the workpiece also having an elongated generally cylindrical stem with external male screw threads, the stem extending outwardly from the fixed member and through the rotatable member, the stem and the rotatable member being laterally spaced to form an annular space;

a tool having a power output end and a power input end, the tool having a cylindrical interior bore with a circular cross sectional configuration along its entire length, the tool having a first exterior surface with a hexagonal cross sectional configuration along the majority of its length from the power input end, the tool having a second exterior surface with a square cross sectional configuration forming rectangular bearing surfaces along the minority of its length from the power output end, the power output end being of a size to be positioned in the space between the stem and the rotational member with the four rectangular bearing surfaces of the power output end in a force-applying contact with the four inwardly facing rectangular surfaces of the rotatable member, the stem being within the bore of the tool; and a fixed open end wrench with a handle adapted to be held and rotated by a user and an operational end with contiguous rectangular surfaces about 120 degrees from each other, the contiguous rectangular surfaces positionable in contact with the power input end of the tool for rotating the tool and rotatable member upon rotating the handle of the wrench.

6. An adaptor tool assembly for applying a rotational force to outwardly facing rectangular surfaces through a drive of a socket wrench, the adaptor tool assembly comprising, in combination:

a workpiece in the form of a rotatable bolt having male screw threads and a generally cubical head, the head having four outwardly facing rectangular surfaces in a square configuration;

a tool having a power input end and a power output end, the tool having a rectangular interior bore with a square cross sectional configuration along its entire length forming four inwardly facing rectangular bearing surfaces, the tool having an exterior surface with a hexagonal cross sectional configuration along its entire length, the power output end being of a size to be positioned over the head of the rotatable bolt with the four inwardly facing rectangular bearing surfaces of the power output end in a force-applying contact with the four outwardly facing rectangular surfaces of the rotatable bolt;

a socket wrench with a handle adapted to be held and rotated by a user and an operational end with a generally cubical drive having contiguous rectangular surfaces ninety degrees from each other;

a socket having a first end with interior rectangular surfaces positionable over the exterior surface of the tool and a second end adapted to receive the contiguous rectangular surfaces of the drive, the contiguous rectangular surfaces positionable in contact with the power input end of the tool whereby a user, when rotating the handle of the wrench, will concurrently rotate the socket and the tool for tightening and loosening the bolt with respect to a recipient surface; and a spring urged ball extending exteriorly from the exterior surface of the tool for contacting one of the interior rectangular surfaces of the socket for enhancing the contact between the socket and the tool.

* * * * *